US008651595B2

(12) United States Patent
Backhaus

(10) Patent No.: US 8,651,595 B2
(45) Date of Patent: Feb. 18, 2014

(54) CABINET, IN PARTICULAR SAFETY CABINET

(75) Inventor: Frank Backhaus, Herford (DE)

(73) Assignee: Dueperthal Sicherheitstechnik GmbH & Co.KG et al, Kleinostheim (DE)

( * ) Notice: Subject to any disclaimer, the term of this patent is extended or adjusted under 35 U.S.C. 154(b) by 474 days.

(21) Appl. No.: 12/708,857

(22) Filed: Feb. 19, 2010

(65) Prior Publication Data

US 2010/0213802 A1 Aug. 26, 2010

(30) Foreign Application Priority Data

Feb. 21, 2009 (DE) ..... 20 2009 002 534 U

(51) Int. Cl.
*A47B 88/00* (2006.01)
*E05C 7/06* (2006.01)

(52) U.S. Cl.
USPC ..... 312/324; 49/367

(58) Field of Classification Search
USPC ..... 312/324, 326, 329, 319.1, 319.2, 319.8, 312/295; 49/116, 120, 122, 123, 366, 367
See application file for complete search history.

(56) References Cited

U.S. PATENT DOCUMENTS

| | | | | | |
|---|---|---|---|---|---|
| 3,516,198 | A * | 6/1970 | Lyons | 49/1 |
| 3,895,849 | A * | 7/1975 | Zehr | 312/324 |
| 4,262,448 | A * | 4/1981 | Flider | 49/367 |
| 4,265,051 | A * | 5/1981 | Williams | 49/7 |
| 4,619,076 | A * | 10/1986 | Livingston | 49/367 |
| 5,061,022 | A * | 10/1991 | Meriwether | 312/324 |
| 5,722,202 | A * | 3/1998 | Cooper | 49/109 |
| 5,944,399 | A * | 8/1999 | Gillispie | 312/324 |
| 5,992,098 | A * | 11/1999 | Flider et al. | 49/367 |
| 6,729,701 | B2 * | 5/2004 | Carter et al. | 312/222 |
| 2003/0001465 | A1 * | 1/2003 | Carter et al. | 312/215 |

FOREIGN PATENT DOCUMENTS

| | | | |
|---|---|---|---|
| DE | 10316656 | * | 5/2004 |
| DE | 202004004855 | * | 9/2004 |
| DE | 102004021912 | * | 10/2005 |
| EP | 2017420 | | 1/2009 |

* cited by examiner

*Primary Examiner* — James O Hansen
(74) *Attorney, Agent, or Firm* — Andrew Wilford

(57) ABSTRACT

A safety cabinet has a body, a pair of doors each pivotal on the body about a respective axis between an open position and a closed position, respective spaced outer guides on the body juxtaposed with the doors, and respective elements displaceable along the guides and coupled to the doors for movement between outer positions when the respective doors are in the open position and inner positions when the respective doors are in the closed positions. A catch between the guides is engageable with the elements and shiftable therewith. A spring also between the guides is engaged between the catch and the body and biases the catch inward toward engagement with the elements. A release device secured between the catch and the body normally holds the catch in an outer position with the spring in a tensioned condition but can release the catch and thereby push the elements with the catch into their inner position to close the doors.

8 Claims, 4 Drawing Sheets

CABINET, IN PARTICULAR SAFETY CABINET

FIELD OF THE INVENTION

The present invention relates to a cabinet. More particularly this invention concerns a safety cabinet such as is used to store toxic, flammable, and/or explosive substances.

BACKGROUND OF THE INVENTION

A typical such safety cabinet has at least two pivotal doors and a spring assembly that biases both doors with a force at least when closing. This spring assembly in normal operations, i.e. during manually opening and closing of the doors, is continually under stress and has a catch that only interacts with the doors when closing, for example, in case of fire.

A cabinet, in particular a safety cabinet of this design is seen in EP 2,017,420. Here, two doors hinged with a cabinet body are jointly connected to a slide that can be displaced in a guide. This way, so-called one-handed opening can be done. This means that movement of one of the door is communicated via an element shiftable in a guide to the other door so the other door also experiences a corresponding movement. Overall, the doors are manually opened and closed. The spring assembly comes into play only when closing, as a rule, in case of fire. To this end, the spring assembly is always tensioned during normal operations, i.e. during manual opening and closing of the doors.

Exclusively on closing and most often in case of fire, the tensioned the spring assembly is released and the spring assembly is actuated to ensure an automatic—and not a manual—closing of the doors. For this purpose, the spring assembly is equipped with release means that normally maintains tension in the spring assembly. For closing, for example in case of fire, the release means operates to release the spring assembly and shift the doors (automatically) into the closed position by means of the catch.

The doors can be any kind of pivotal doors with and one-sided hinging to the body of the cabinet in the case of such a cabinet, in which, in principle, folding doors are also conceivable as for example described in DE 200 19 307.

A cabinet that is equipped this way is most often a safety cabinet, a laboratory cabinet, environment cabinet, tool cabinet, wardrobe or the like in which it is important, in particular in case of fire, to protect the objects and substances or materials stored in the cabinet. They can be, for example, hazardous chemicals such as inflammable fluids, etc. In this connection, closing in the event of fire prevents ignition of the fluids or chemicals.

The prior art of EP 2 017 420 has been proven to be effective overall, but is limited in certain respects in its scope of application, because one-handed opening is pursued practically exclusively. Added to that is that the spring assembly engages at the end of the common slide for the two doors, which is not optimal from the perspective of the transmission of force.

OBJECTS OF THE INVENTION

It is therefore an object of the present invention to provide an improved cabinet, in particular safety cabinet.

Another object is the provision of such an improved cabinet, in particular safety cabinet that overcomes the above-given disadvantages, in particular where the transmission of force by the spring assembly to the doors is improved and there is, in addition, the possibility that different ways of opening can be realized.

SUMMARY OF THE INVENTION

A safety cabinet has according to the invention a body, a pair of doors each pivotal on the body about a respective axis between an open position and a closed position, respective spaced outer guides on the body juxtaposed with the doors, and respective elements displaceable along the guides and coupled to the doors for movement between outer positions when the respective doors are in the open position and inner positions when the respective doors are in the closed positions. A catch between the guides is engageable with the elements and shiftable therewith. A spring also between the guides is engaged between the catch and the body and biases the catch inward toward engagement with the elements. A release device secured between the catch and the body normally holds the catch in an outer position with the spring in a tensioned condition but can release the catch and thereby push the elements with the catch into their inner position to close the doors. Thus according to the invention the spring assembly formed mainly by the catch and spring is located between the guides on both sides of the doors.

In general, the spring assembly engages at least at a slide of the respective door in the closing operation with its catch. This means each door can, in principle, be equipped with its own slide. In this case, the two slides are separate from each other but are operated by at least one catch jointly when closing, for example, in case of fire. For this purpose, the two connecting elements may be closely adjacent each other, at least at inner ends.

In any event, the configuration is most often such, that the single catch of the spring assembly can engage both the slides when closing, so that the doors that actively coupled to their respective slides are also jointly automatically closed by the catch in the closing operation. In this case, the separate configuration of the slides so that the doors can be opened and closed manually separately. To open both doors, both hands are used.

Beyond that, it is within the scope of the invention to couple the doors together by an element or slide for joint pivoting. Then, the difference with respect to the previously described two-handed opening and opening with one hand or one-handed operation is possible. As a result of the common connecting element coupling the two doors, one door follows the other door and/or its movements.

Either way, the guides on both sides of the doors regularly serve to guide the two elements or the common element. Hence the two doors are each connected to the one common or to the two connecting elements by a respective link. As soon as the catch engages one or the other of the two connecting elements, the spring assembly ensures when closing that the one connecting element or the two connecting elements are both subjected to a force in the closing direction. Since the doors are connected by means of the slides and or links to the respective elements or to the common element, the doors also both are subjected to a corresponding force in the closing direction. The force is supplied a compression spring that essentially forms part of the spring assembly connected to the catch.

The previously mentioned compression spring is when tensioned and in normal operation, longitudinally extended. This is ensured by a fixation element that holds the longitudinally extended spring tensioned. As soon as the anchor or release element (for example, in the case of fire) is actuated the longitudinally extending compression spring can relax and contract. This pulls back the catch against the one or both elements to move them in the direction of the closed position of the doors.

Since the spring assembly is located between the guides of the doors on both sides or on the one or the other connecting element and otherwise is a parallel to the two guides on both sides and is located at approximately the midpoint between them, a particularly favorable transmission of force to the one or the other of the two connecting elements is observed. In fact, the spring assembly ensures that on closing the one or the other of the two connecting elements is displaced linearly along the guides on both sides, because the respective connecting element is linearly displaceable in the guides on both sides. As the application of force in accordance with the invention takes place in the center between the two guides, and the spring assembly generates a closing force in the closing operation that is essentially generated in the same direction with respect to the guides on both sides that are located parallel to each other, faultless functionality results.

In the ideal case, the closing force exerted by the spring assembly in the closing operation is distributed evenly between the two guides extending parallel to each other on both sides of the spring assembly. This is the case even more so as the closing force extends directly in the direction of these guides and consequently ensures with no problem that the one common connecting element or the two connecting elements along the guides on both sides are linearly displaced.

This means that the design of the cabinet in accordance with the invention, particularly the safety cabinet, permits one-handed operation as well as two-handed operation. To this end, it is only required that the common slide coupling the two doors in one-handed operation is replaced by a partitioned slide quasi central in the section of the catch of the spring assembly. As a result of this, a large product variety with largely conforming base elements is made available. At the same time, the transmission of force by the spring assembly to the one common slide or the two slides is optimized, so that in particular, there is no danger of cants of the common slide or the respective slides in the respective guides. It is thus ensured that in the closing operation, the doors will be closed reliably.

Thereby, it should be emphasized that the fixation element that retains the longitudinally extended compression spring of the spring assembly or in general the spring of the spring assembly retains its tensioned condition in normal operation and is normally only be actuated in case of fire. In principle it should however be noted that the release means can be operated in the event of something other than a fire, for example, by means of a switch, a magnet, etc. in order to ensure the desired automatic—and not manual—closing. As a rule, the closing operation coincides, however with a fire situation.

Finally, it has also been shown to be effective when the closing element is equipped with at least one damper. In the case of two slides, each slide has its own damper. This way, the closing spring regularly ensures that manual closing movements of the door or the doors are damped shortly before attaining the closed position.

As a result, a cabinet, in particular a safety cabinet, is provided that opens many possibilities of use. Thus, the cabinet can be configured starting with a basic principle, for one-handed opening or one-handed servicing as well as for two-handed servicing. In fact, the change from one mode of operation to the other requires only an exchange of one or more slides and perhaps the additional attachment of a closing spring. Thereby, the hinging of the doors, the guide of one or more slides, the attachment and the operation of the spring assembly remain unaffected. In this manner, the number of the required construction components can be drastically reduced, which leads to significant cost savings.

Added to that is that the attachment of the spring assembly between the guides on both sides of the doors optimizes the transmission of force in the closing operation. This means that the closing forces exerted by the spring assembly in the closing operation optimally engage the doors so that they are reliably operated in the closing operation. Moreover, the invention ensures that the spring that is tensioned in normal operations or the longitudinally extended compression spring of the spring assembly closes the revolving spring doors reliably even after years or decades.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
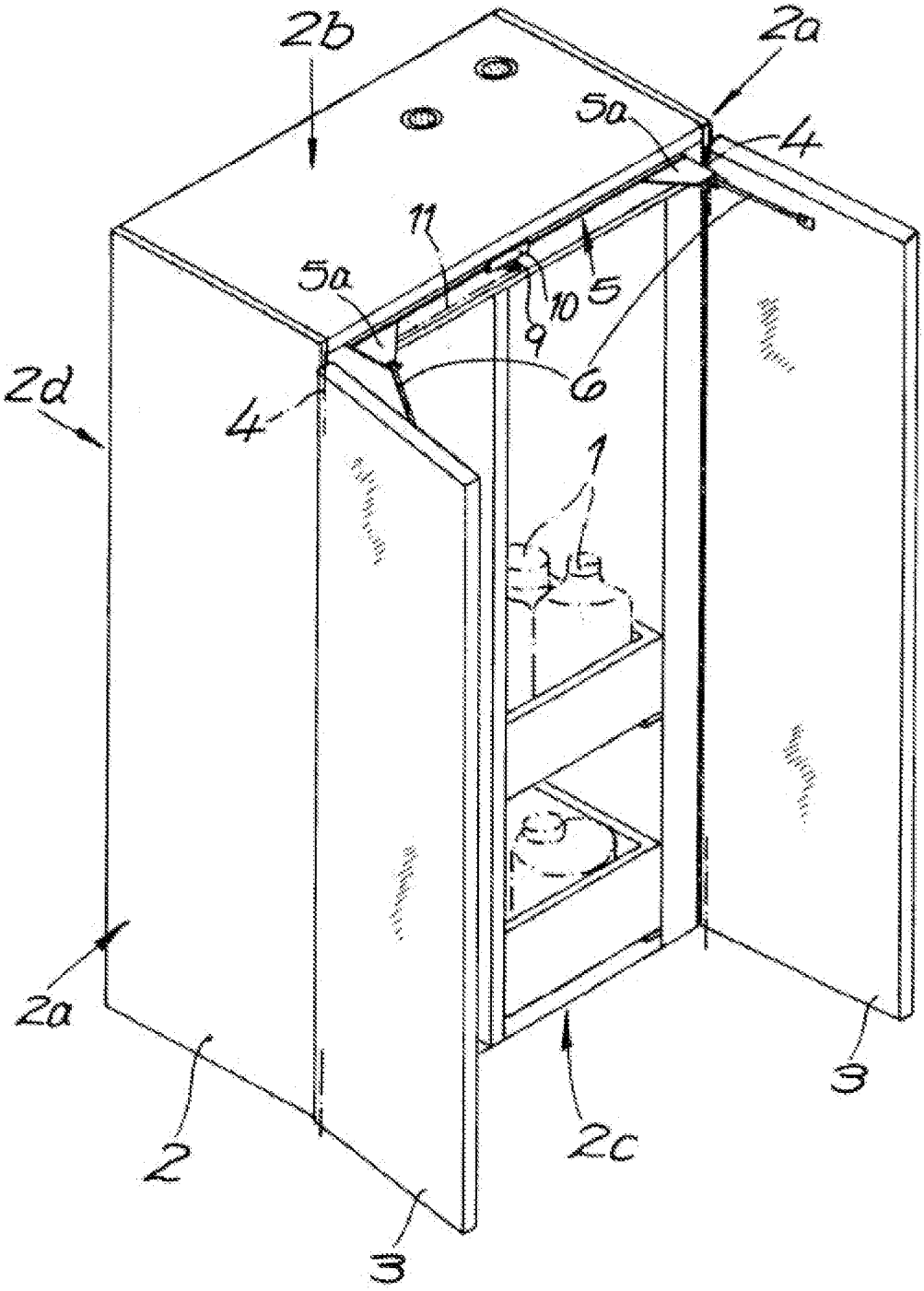
FIG. 1 is a perspective view of a safety cabinet according to the invention.

As seen in FIG. 1 containers 1 of dangerous chemicals are stored in a safety cabinet having a body 2. The body 2 has a pair of planar, spaced, and vertical side-wall panels 2*a*, a horizontal and planar top-wall panel 2*b* bridging upper edges of the side walls 2*a*, a horizontal and planar bottom wall or floor panel 2*c* bridging bottom edges of the side panels 2*a*, and a vertical and planar back wall panel 2*d* attached to rear edges of the panels 2*a*, 2*b*, and 2*c*, together forming a horizontally forwardly open parallepipedal box. Two substantially identical planar doors 3 are pivotal on hinges 4 about respective vertical axes at front edges of the side panels 2*a*. The doors 3 can be opened and closed synchronously with one hand (one-handed operation) or also separately from each other, operated with two hands (two-handed operation) depending on setup. The doors 3 can in principle also be folding doors.

Figures 2, 2A:
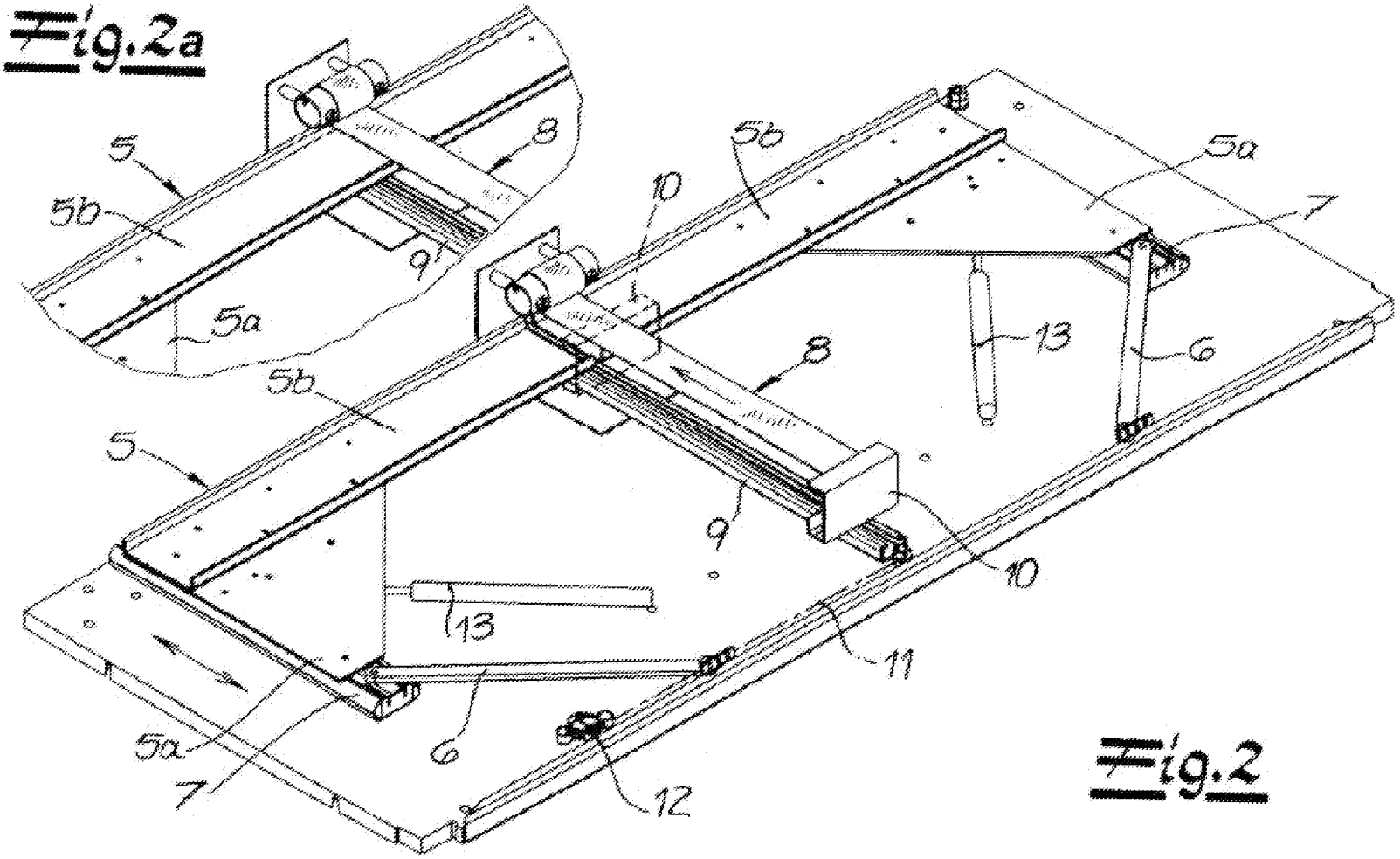
FIG. 2 is a perspective view of the door-operating mechanism according to the invention.
FIG. 2*a* is a detail view of a variant on the mechanism of FIG. 2.
Figure 3:
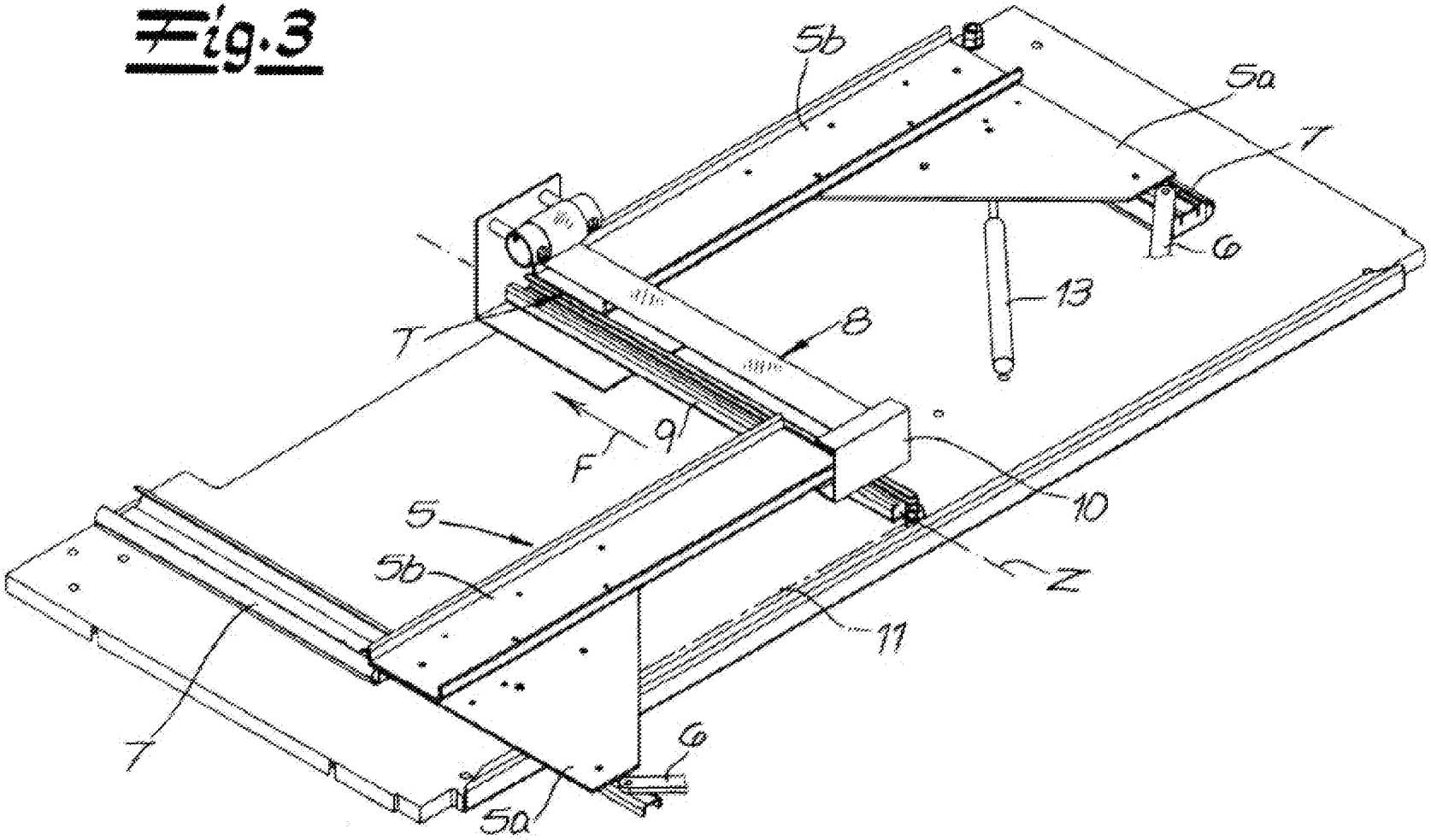
FIG. 3 shows the mechanism of FIG. 2 with only one door open.
Figure 4:
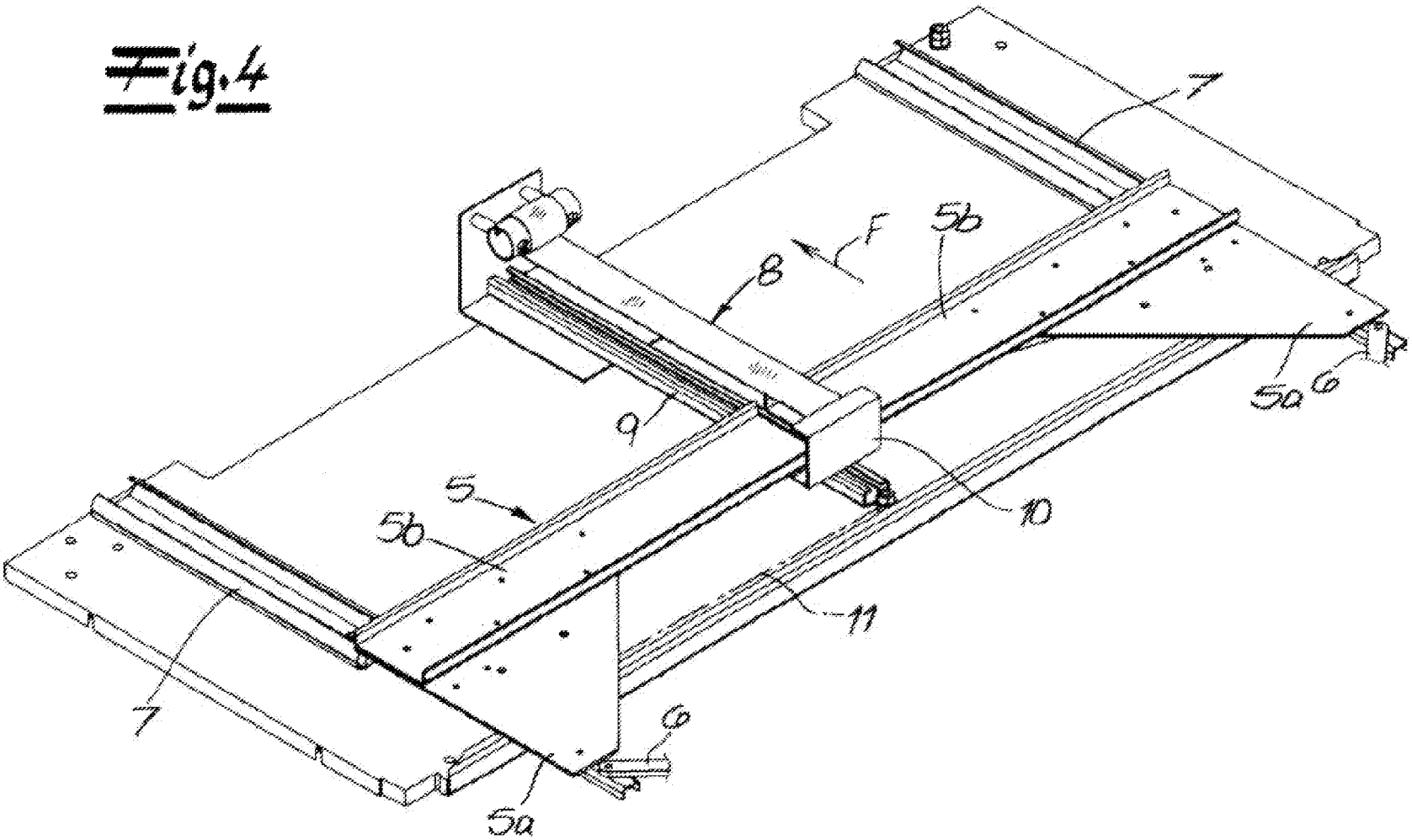
FIG. 4 show the mechanism of FIG. 2 with both doors open.

The doors 3 are connected to a slide 5 that is just underneath the top wall 2*b*. FIGS. 2-4 show that the slide 5 is connected by rigid links 6 or in general by means of connecting elements to the doors 3.

Two parallel guide rails 7 near the horizontal outer edge of each end of the slide 5 ensure that the slide 5 can move in a horizontal straight line front-to-back underneath the top wall 2*b* as shown by a double-headed arrow in FIG. 2. Each link 6 is pivoted offset from the respective hinge 4 to a respective one of the doors 3 and to an extension 5*a* at an end of the slide 5. In fact, the slide 5 is basically formed by the two extensions 5*a* and a bar 5*b* projecting horizontally inward from each of the guides 7, each extension 5*a* and bar 5*b* forming a rigid L-shaped element.

The two extensions 5*a* are triangular gussets, here right triangles. This way one leg of this right triangle is connected to the bar 5*b* and the other leg rides in the respective guide 7.

The pivot on the extension 5*a* for the connecting element 6 is at the front outer end of the other leg of the right angle.

Both doors 3 can be connected to a common slide 5 as shown in FIG. 2*a*. In this case, the bars 5*b* are one continuous piece. This means that with a common slide 5 for the two doors 3 both doors 3 will open and close synchronously for one-handed operation.

In this case, when one of the doors 3 is manually opened or closed, the respective link 6 ensures that the pivoting of this door 3 is converted into a straight-line or linear movement of the respective slide part 5*a* along the respective guide 7 and identical sliding of the other slide part 5*a* and pivoting of the other door 3. Thus this linear movement of the common slide 5 is converted into a pivoting of both doors 3. As a result, both doors 3 can be synchronously actuated for one-handed operation.

The bar 5*b* can also be formed by two separate parts as shown in FIGS. 2, 3, and 4. Thus manual actuation of only one door 3 only ensures that the respective link 6 converts this pivoting of the respective door 3 into a linear movement of the respective slide 5 along the guide 7. Whether there is a common slide or two of them, they slide on the underside of the top wall 2*b* of cabinet body 2.

Thus each slide 5 has a respective guide 7 in which it can move in a straight line, and when there are two of them, they are mirror-symmetrical to each other at a common vertical plane Z bisecting the body 2. Thus the slide 5 or the two slides 5 are linearly displaceable in the guides 7 on both sides. An overall mirror image configuration is recommended of the one or the two slides 5 to a central plane Z only shown in FIG. 3 relative to the body of the cabinet 2.

In addition to the described normal manual opening and closing movements of the doors 3, they can also be opened and/or closed automatically. Automatic closing of the doors 3 can also entail a latching operation. For this purpose, the safety cabinet in accordance with the invention is equipped with a spring assembly 8, 9, 10 that ensures that the two doors 3 are acted on by a force at least when being closed. This is indicated by the dotted illustration of the catch 10 in FIG. 2, as this dotted illustration of the catch 10 corresponds to the end position of the spring assembly 8, 9, 10 when closing.

More particularly, the spring assembly 8, 9, 10 is functionally decoupled in normal operation from the slide 5 or the two slides 5. This means that the opening and closing movements performed in normal operation of the doors 3 do not have any affect on the spring element 8, 9, 10. The spring element 8, 9, 10 remains completely unaffected by movements of the doors 3. Only in closing operation does the spring assembly 8, 9, 10 ensure that the doors 3 are impinged upon with a force in the direction of their closed position and consequently experience an automatic closing.

In detail, the spring assembly 8, 9, 10 is in its tensioned position in normal operation, as can be seen in FIGS. 2-4. The assembly 8, 9, 10 therefore comprises a spring 8 connected to a catch or entrainment element 10 that can ride in a guide rail 9 extending parallel to the guides 7. In the tensioned or compressed, that is loaded, condition of the spring 8, the catch 10 is in the illustrated outer end position in which it is engageable inwardly against ends of the bar(s) 5*b*. Here the spring 8 is an elongated leaf spring that lies on the plane Z and that when relaxed is curled up, so that in the extended position of FIGS. 2-4 it is seeking to retract the catch 10 rearward.

The catch 10 is secured to one end of a cable 11 or the like that extends along the front edge of the top wall 2*b* and whose opposite end is secured to an anchor 12 designed to release the cable 11 when heated above a predetermined temperature below the ignition temperature of the materials in the containers 1. Here the anchor 12 is a simple bimetallic construction that separates when heated. Alternately it can be a glass cartridge held between two metal cages or clips and designed to rupture when heated.

Thus if one or both of the doors 3 of the cabinet are swung into the open positions shown in FIG. 1, they will stay there, with the bar(s) 5*b* of the slide(s) 5 spaced slightly rearward by a few millimeters from and out of contact with the catch 10. The user can comfortably deal with the containers 1 using both hands, without having to hold the doors 3 open with the other hand. Any manual closing and opening action has no effect on the spring assembly 8, 9, 10.

In the event of a fire or the like, however, when the doors 3 are open, the anchor 12 will release the cable 11 so that the tension in the spring 8 will rearwardly retract the catch 10 and exert a force F on the slides 5, rearwardly retracting them and closing the cabinet.

In order to prevent a violent slamming of the doors 3, whether by manual or automatic operation, dampers 13 are provided that engage or are effective on the slides 5 as they approach their rear end positions. These can be pneumatic cylinders effective as on a standard door closer to allow their pistons to move freely until they approach one end of their cylinders.

I claim:

1. A safety cabinet comprising:

a body;

a pair of doors each pivotal on the body about a respective axis between an open position and a closed position;

respective parallel, straight, and spaced outer guides on the body juxtaposed with the doors;

respective slides displaceable independently of each other in straight lines parallel to each other along the outer guides and coupled to the doors for straight-line movement between outer positions when the respective doors are in the open position and inner positions when the respective doors are in the closed positions;

a center guide between the slides;

a catch between the outer guides, riding in the center guide, engageable with the slides, and movable in the body parallel to the slides;

a spring between the outer guides, engaged between the catch and the body, and biasing the catch inward toward engagement with both of the slides; and a fusible closing element secured between the catch and the body and normally holding the catch in an outer position spaced outward from the slides and with the spring in a tensioned condition, whereby on fusing the element releases the catch so that it engages the slides and pushes the slides into their inner positions, thereby closing the doors.

2. The safety cabinet defined in claim 1, further comprising:

respective links having outer ends pivoted on the doors offset from the respective axes and inner ends pivoted on the slides.

3. The safety cabinet defined in claim 1 wherein in the open position of the doors and outer positions of the slides and of the catch the respective slides are spaced inward from the catch.

4. The safety cabinet defined in claim 1 wherein the spring is a rolled spring that is mostly straight in the tensioned condition and in the outer position of the catch.

5. The safety cabinet defined in claim 1 wherein the slides are shiftable parallel to each other in the respective guides and symmetrically flank the spring.

6. The safety cabinet defined in claim 1, further comprising damper means for damping inward pivoting of the doors as they approach the respective closed positions.

7. The safety cabinet defined in claim 1 wherein the slides have juxtaposed inner ends engageable by the catch and outer ends coupled to the respective doors.

8. The safety cabinet defined in claim 7 wherein the slides are generally L-shaped and symmetrically flank the spring.

* * * * *